United States Patent [19]

Sanders, Jr.

[11] Patent Number: 4,533,268

[45] Date of Patent: Aug. 6, 1985

[54] POSITION INDICATOR FOR HIGH SPEED PRINTERS

[76] Inventor: Roy C. Sanders, Jr., Burton Hwy., Wilton, N.H. 03086

[21] Appl. No.: 647,865

[22] Filed: Sep. 5, 1984

Related U.S. Application Data

[63] Continuation of Ser. No. 436,949, Oct. 27, 1982, abandoned.

[51] Int. Cl.[3] ..... B41J 19/30

[52] U.S. Cl. ..... 400/322; 400/328; 250/231 SE

[58] Field of Search ..... 400/320, 322, 328; 250/231 SE, 237 G

[56] References Cited

U.S. PATENT DOCUMENTS

| | | | |
|---|---|---|---|
| 3,833,891 | 9/1974 | Howard et al. | 400/328 |
| 4,093,383 | 6/1978 | Feist et al. | 250/231 SE |
| 4,114,750 | 9/1978 | Baeck et al. | 400/328 |
| 4,152,589 | 5/1979 | Mitchell | 250/231 SE |
| 4,210,404 | 7/1980 | Hanger | 400/328 |
| 4,279,523 | 7/1981 | Ringle | 400/328 |
| 4,343,012 | 8/1982 | Knapp | 400/320 |
| 4,358,753 | 11/1982 | Cascini | 250/231 SE |

FOREIGN PATENT DOCUMENTS 2828661 1/1980 Fed. Rep. of Germany ..... 400/320

OTHER PUBLICATIONS

Branson et al., "Character Wheel . . . ", IBM Technical Disclosure Bulletin, vol. 16, No. 5, p. 1515, 10/73.

*Primary Examiner*—William Pieprz

*Attorney, Agent, or Firm*—Hayes, Davis & Soloway

[57] ABSTRACT

This invention provides a printer, having an elongate platen and a print head carriage adapted for relative movement therebetween longitudinally of the platen, in which a position indicator ascertains the position and direction of motion of said carriage longitudinally of said platen. The indicator comprises an optical position encoder rotatably mounted on an axis fixed longitudinally of said platen, and a carriage position responsive means connected to said carriage and said encoder to transmit said relative movement to said encoder to rotate said encoder in synchronism with said relative movement. The encoder has a pattern of detectable indicia and a detector is responsive to said indicia to provide a signal indicative of said position.

8 Claims, 5 Drawing Figures

POSITION INDICATOR FOR HIGH SPEED PRINTERS

This is a continuation, of application Ser. No. 436,949 filed Oct. 27, 1982 and now abandoned.

The present invention relates to a position indicator for ascertaining the transverse position of a print head or other device relative to a surface, e.g. of a sheet or document such as, the transverse location of the dot matrix print head of a high speed printer relative to a sheet of paper upon which indicia (characters, graphics and the like) are formed by the operation of the print head. However, the arrangement may be employed in other contexts.

In the discussion herein, for simplicity, emphasis is placed upon a position indicator (locator) in the context of locating the transverse position of a print head relative to a platen or, more precisely, a sheet of paper positioned adjacent the platen, in the context of a printer of the type disclosed in U.S. Pat. No. 4,159,882. However, it will be appreciated that the position indicator has use in other types of printers and in other types of apparatus.

In a high speed printer of the type disclosed in the aforesaid patent, a print head is moved transversely (i.e., parallel to the axis of the printer platen) across the paper upon which characters are to be printed by a stepper motor though a capstan and cable arrangement. The stepper motor serves not only as the drive mechanism but because of its position orientation with respect to timed pulses, also serves as the determinant of the transverse position (or location) of the print head relative to the paper. Stepper motors are relatively expensive and they introduce transient mechanical forces into the system, which must be carefully controlled in order to obtain accurate positioning.

A commonly used method of using an optical sensor is to mount a sensor like a Hewlett Packard HEDS 5000 series optical sensor on the horizontal slew motor. This suffers the disadvantage that the motor axis oscillates very violently upon turnaround causing great complication in the quadrature detection circuits needed in order to prevent loss of registration. Furthermore, there is appreciable stretch (2 to 10 mils.) of the cable during acceleration. In addition, since this cable must be attached to the print head carriage near the center of mass, bearing tolerance introduces appreciable errors as to where the print head will print on the paper.

An alternative arrangement is used in Printek's Model 920 printer. The arrangement has a rotary optical encoder mounted on the print head carriage and driven by the carriage drive cable. This arrangement produces significant errors in print location as a result of the tolerance in the bearings on the horizontal traverse slide bars.

The position locating function of the stepping motor can also be provided by an optical fence system employing light, but any such system must overcome a number of problems common to optical fence systems in order to obtain sufficient resolution to effect the accuracy required.

In general, an optical fence system uses a bar pattern where the bars alternate between being highly opaque and highly transmissive of light. The spacing between successive bars of the same kind can be referred to as the wavelength. Alternatively, the bar pattern can be reflective, where the bars alternate between being highly absorptive and highly reflective of light.

Simply having an optical fence as described is insufficient to use it to resolve position. Since ordinary light, whether transmitted through or reflected from such a fence, will scatter; some way must be provided to take only a perpendicular component of the light from the fence. One way of doing this is to use a very narrow (with respect to the wavelength of the pattern) slit mounted closely (with respect again to the pattern wavelength) adjacent to the fence. Within certain limits, such a scheme will work, but as the pattern wavelengths get small the total amount of light (area intensity) gets very small, and the signals produced become so weak as to be very difficult to detect.

Another method employs a transmissive fence operating in conjunction with a second transmissive fence of identical geometry. Motion of the second fence relative to the first shifts the phase angle of the second pattern with respect to the first. When the two transmissive portions are in direct alignment, half of the source light is transmitted through the transmissive portions of both fences, and is available for impinging on a detector. When the opaque portion of the first fence is aligned with the transmissive portion of the second fence, the transmissive portions of the first fence as a consequence being aligned with opaque portion of the second fence, all of the source light is blocked by opaque regions, and hence the light is prevented from impinging on a detector. The advantage of this type of fence is that the total amount of light available to the detector is the sum of the light through several transmissive bars when so aligned, and hence the ratio of light to dark intensities is significantly better than is the case with a single slit.

Notwithstanding such advantages, the dual fence system begins to encounter significant problems as attempts are made to increase resolution. Specifically, as the pattern wavelength decreases to where the spacing between the fixed and movable bar patterns is a significant part of the pattern wavelength, scattering by refracted light increases the dark intensity (amount of light impinging on the detector when the patterns are aligned opaquely), thereby reducing the light to dark ratio. Physical variations and vibrations of the mechanical system cause amplitude modulation of the detected signal, making recognition difficult. Dust and dirt, grease and other contaminants increase scattering and absorb light, thereby reducing the light to dark ratio. All of these problems make achieving high resolution with conventional techniques difficult. Some of the problems can be overcome with careful design, close tolerance, etc., but the economics of the market place impose a limit on how much can be done.

One such method of using a linear optical fence is described in U.S. patent application No. 428,739 filed on Sept. 30, 1982. This method suffers the disadvantage that the ideal place for the optical sensor is the same as the print head. When the optical sensor is placed next to the print head, the tolerance in the bearings on the horizontal traverse slide bars results in significant errors in the location on the paper where the print head will print.

Accordingly, it is the object of the present invention to provide a highly accurate locator mechanism for the printers that does not suffer the above disadvantages and which provides a less expensive and reliable mechanism. It is a further object of the invention to provide such a mechanism which permits other than stepper motors (e.g. a D.C. motor) to be used for carriage traverse.

According to the present invention there is provided apparatus having first and second members adapted for relative movement therebetween, and a drive means for producing said relative movement, a position indicator for indicating the relative position of said first and second members, said position indicator comprising an optical position encoder means mounted for rotation relative to said first member comprising, a position responsive means adapted to transmit said movement from said second member to rotate said optical position encoder means in synchronism therewith, said encoder means having a pattern of detectable indicia, and a detector responsive to said indicia to provide a signal indicative of the rate and amount of said rotation of said encoder means.

According to a preferred form of the present invention there is provided a printer having an elongate platen and a print head carriage adapted for relative movement therebetween longitudinally of the platen, a position indicator, for ascertaining the position of said carriage longitudinally of said platen, comprising an optical position encoder rotatably mounted on an axis fixed longitudinally of said platen a carriage position responsive means connected to said carriage and said encoder to transmit said relative movement to said encoder to rotate said encoder in synchronism with said relative movement, said encoder having a pattern of detectable indicia, and a detector responsive to said indicia to provide a signal indicative of said position.

The position responsive means is preferably a substantially non-extensible cable connected to the carriage closely adjacent to the printing location of a print head mounted on the carriage, thereby faithfully to transmit relative movement of the printing (pin) location and the platen.

Preferably the encoder is in the form of a disc and the pattern of indicia consists of thin stripes (or bars) oriented radially to the axis of the disc. The stripes are alternately transparent and opaque. A light source directs light upon the pattern to provide a transmitted light pattern comprising a plurality of intense light regions (photon packets) separated by regions of substantially zero light intensity, there being relative movement between the disc and the light source so that each region of the plurality of regions changes from intense light (i.e., light) to substantially zero light (i.e., dark) as a function of distance. A lens is positioned to focus light from the source onto the pattern. A further lens is positioned to receive the transmitted light pattern and serves to focus the light pattern. A reticle is positioned to receive the focused light pattern from the disc. The reticle consists of a short strip with a pattern of thin stripes oriented perpendicular to the annular extension of the strip. These thin stripes are alternately transmissive and non-transmissive (either absorptive or reflective). When the magnification ratio of the lens system is unity, the spatial wavelength of the thin stripes of the reticle are the same as that of the disc. It will be recognized that other embodiments are possible using different magnification ratios in the lens system, where the wavelength of the reticle pattern would be scaled suitably in accordance with the magnification ratio of the lens such that the resultant light pattern impinging on the reticle would have the same spatial wavelength as that of the reticle. Under these conditions, the action of the reticle is such as to permit light that is aligned with its transmissive areas to pass through it, and to block light that is aligned spatially with its reflective areas. When the transmitted light from the disc is aligned spatially with the transmissive region of the reticle, the maximum amount of light possible passes through the reticle. When the alignment is with the non-transmissive region of the reticle, the minimum amount of light passes through the reticle. A quadraphase detector is mounted behind the reticle to detect the total amount of light coming through the reticle. The detector provides a signal that can be analyzed to indicate transverse position relative to the light source. The focused light, so analyzed, consists of at least several of the intense light regions (photon packets) which combine or average in the detector means to generate said signal.

The output of the Quadraphase Detector is processed to provide digital direction and video signals representing the direction of carriage traverse and the position of the carriage relative to the platen. The resulting signals are fed to a microprocessor which keeps a 16 bit register of the horizontal position of the print head. The microprocessor measures the velocity (by measuring the number of video pulses received in the time of flight of print head) and acceleration by measuring the difference in successive velocity measurements. As an alternative this could be done by hardware. The microprocessor uses the video pulses to unload a pin fire buffer and generate firing pulses for the print head and uses the velocity and acceleration to modify the unloading address to compensate for the time of flight.

The present invention will now be described, by way of example, with reference to the accompanying drawings, in which.

Figure 1:
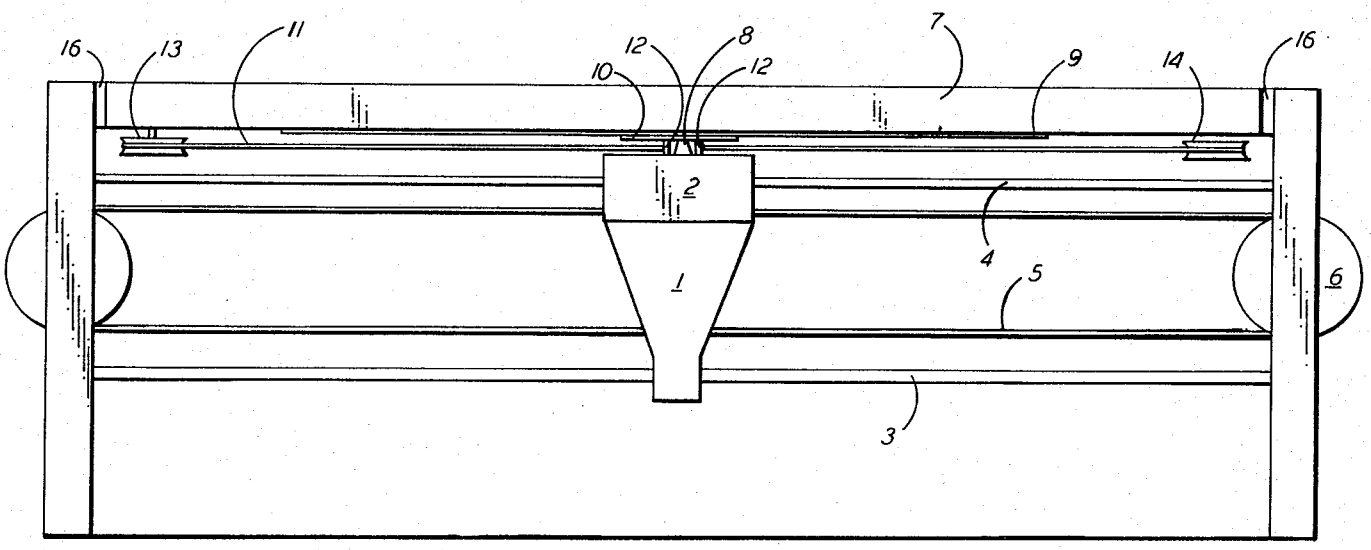
FIG. 1 is a diagrammatic plan view of the carriage drive assembly of a printer incorporating the present invention.
Figure 2:
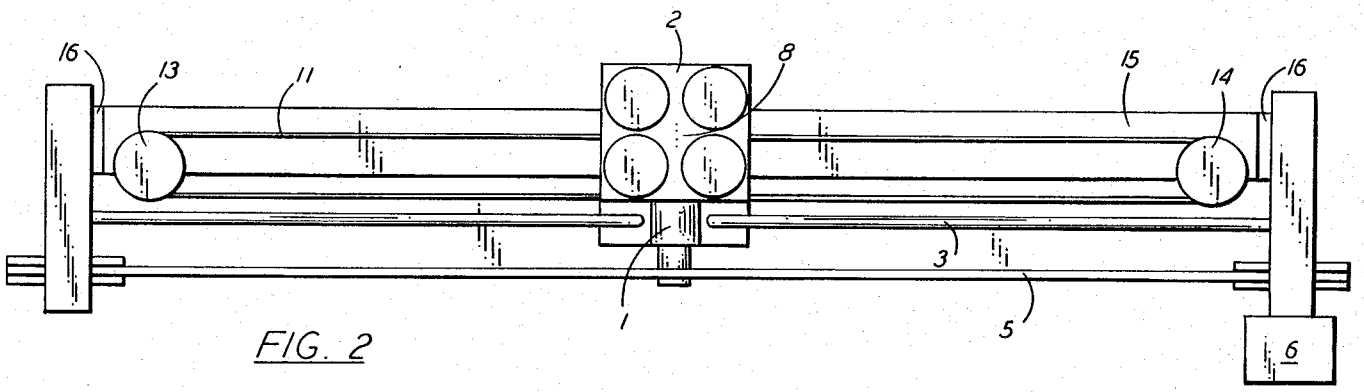
FIG. 2 is a diagrammatic front elevation of the carriage drive arrangement shown in FIG. 1.

With reference first to FIGS. 1 and 2 which illustrate the carriage drive (horizontal slew mechanism) of the present invention, a print head carriage 1 upon which a dot matrix print head 2 is mounted is slidably supported on horizontal support rods 3 and 4 along which it is moved by a drive belt 5 which is driven by a D.C. motor 6 to produce the desired transverse motion of the print head relative to platen 7.

The dot matrix print head 2 has print head pins 8, the selective operation of which creates a printed image on paper 9 by means of a ribbon 10.

A carriage position responsive cable 11 is affixed to the carriage by means of two posts 12 located closely adjacent the pin location in the print head 2. This ensures faithful transmission of print location movement relative to the paper 9 regardless of tolerances and wear in the carriage bearings on the support rods. The character position responsive cable extends around an idler pulley 13, mounted for rotation on the printer chassis at one end of the carriage traverse along the platen 7, from one pin 12 to an optical disc encoder 14 mounted for rotation at the other extreme of the traverse of the print head carriage along the platen. The optical disc 14 carries a plurality of indicia in the form of equally spaced radial opaque lines with the spaces between the lines being transparent.

It will be appreciated that belts and cables as used herein are interchangeable and that other flexible drive elements, for example, chains or other multiple link elements, could be substituted for the belts or cables of the present invention without departing from the inventive concept. Because the carriage position responsive cable 11 drives only the idler pulley 13 and the optical disc encoder 14 there is very little inertia and a very light cable can be used without producing error causing stretch thereof. As a result of this, the optical disc encoder will faithfully measure the horizontal (transverse) position of the print head relative to the platen and paper supported on that platen. In this preferred embodiment both the idler pulley 13 and the optical disc encoder 14 are mounted for rotation on the relatively rigid platen structure extrusion 15 which is mechanically isolated by vibration isolaters 16 from the structure support the drive D.C. motor 6.

Figure 4:
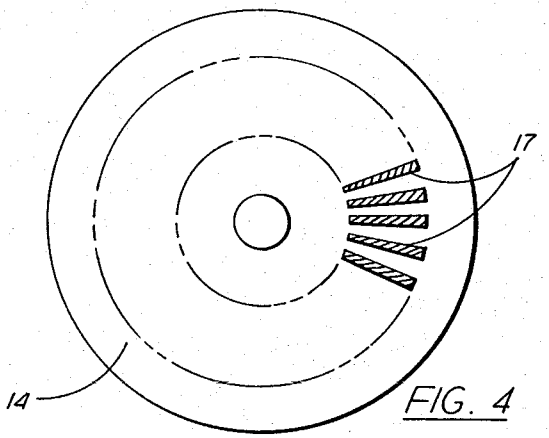
FIG. 4 is a fragmentary sectional elevation of the optical disc encoder shown in FIG. 3 together with the optical sensor arrangement.
Figure 3:
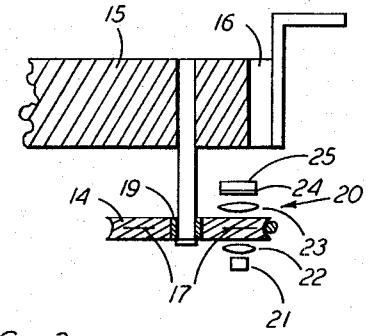
FIG. 3 is a fragmentary enlarged view of the optical disc encoder of the present invention.

With reference now to FIGS. 3 and 4 the optical disc encoder 14 is a pulley which has a peripheral groove to engage cable 11. The pulley is made of clear plastic with the plurality of equi-spaced radial opaque lines 17 (optical fence) being sandwiched in the center of the pulley. The pulley is mounted on a shaft 18 supported for rotation relative to the platen extrusion 15 by means of a bearing 19. The optical detector and transmitter 20 includes a light transmitter 21, in the form of a light emitting diode (LED) and a lens 22 adapted to focus the light emitted by the LED onto the radial lines 17. On the side of the optical disc encoder 14 remote from the LED 21 and lens 22, a lens 23 focuses light received by way of the spaces between the plurality of line 17 from the LED onto a quadraphase reticle 24 which screens the light so received onto quadraphase detectors 25 which in turn provide video output signals indicative of the light received and consequently the transverse position of the print head carriage 1 relative to platen 7. It will be appreciated only a portion of the radial lines 17 are shown in FIG. 4 and that these radial lines in fact are equispaced throughout the annular area of the optical disc encoder in which they are shown.

In order to maintain a constant level of signal from the detector, it is important that the light source illuminate the portion of the disc uniformly. This can be accomplished by maintaining the light source and the light sensor in rigid relative mechanical relationship to one another closely adjacent the disc faces. The reticle 24, which is disposed at the image plane, has a reticle pattern of transparent regions or stripes (e.g., slots) separated by opaque regions that correspond both in size (i.e., width) and position to the light regions and the regions of the transmitted light pattern. In the disclosed embodiment there is one-to-one correspondence between the widths, but the reticle pattern and the transmitted pattern can have other relationships, depending on the magnification ratio of the lens system. The light pattern is transmitted through the reticle when the light regions register with the transparent regions and the light pattern is blocked when the light regions register with the opaque regions. The quadraphase detectors 25 receive the total light transmitted through the reticle; the detector converts the light energy to a current that can be analyzed to indicate transverse position of the print head relative to the platen. The light so analyzed consists of at least several of the intense light regions which combine or average in the detector to generate the voltage signal. The detector in the sensor assembly is a detector pair.

The reticle is a split reticle with regions in spatial quadrature to one another to sense respectively the zero-phase light and 90°-phase light (with respect to reticle stripe spacing) respectively. It will be observed that the regions are spatially in quadrature with one another, that is, regions of one part of the reticle are displaced or offset to the right of the regions of its other part one-half the width of each region and hense collect their maximum light at a place that differs from the place that the regions of the other collect maximum light. The O-phase light is sensed by one detector (e.g., a light sensitive diode) to provide a voltage signal which is connected as input to an amplifier whose output is connected as input to a comparator. The 90°-phase light is sensed by the detector whose output is amplified and connected to a comparator. The reticle is disposed immediately adjacent (i.e., juxtaposed to the detector(s)). It should be noted that the reticle can be fabricated on the surface of the detector; the close proximity of the reticle to the detector greatly reduces light scattering to the detector, which permits a high ratio of light to dark signal from the detector even at very short pattern wavelengths. Having a split reticle with the two reticles thereof offset from one another in the direction of travel of the disc relative to the light source-sensor permits the circuit illustrated in FIG. 5 to ascertain direction of travel; thus + direction can be distinguished from − direction travel. The offset of the reticle parts typically is one-fourth line width, that is, 90 spatial degrees. Accordingly the two reticles forming the split reticle are separated in the direction (i.e., in the direction of travel) to occupy discrete locations.

Figure 5:
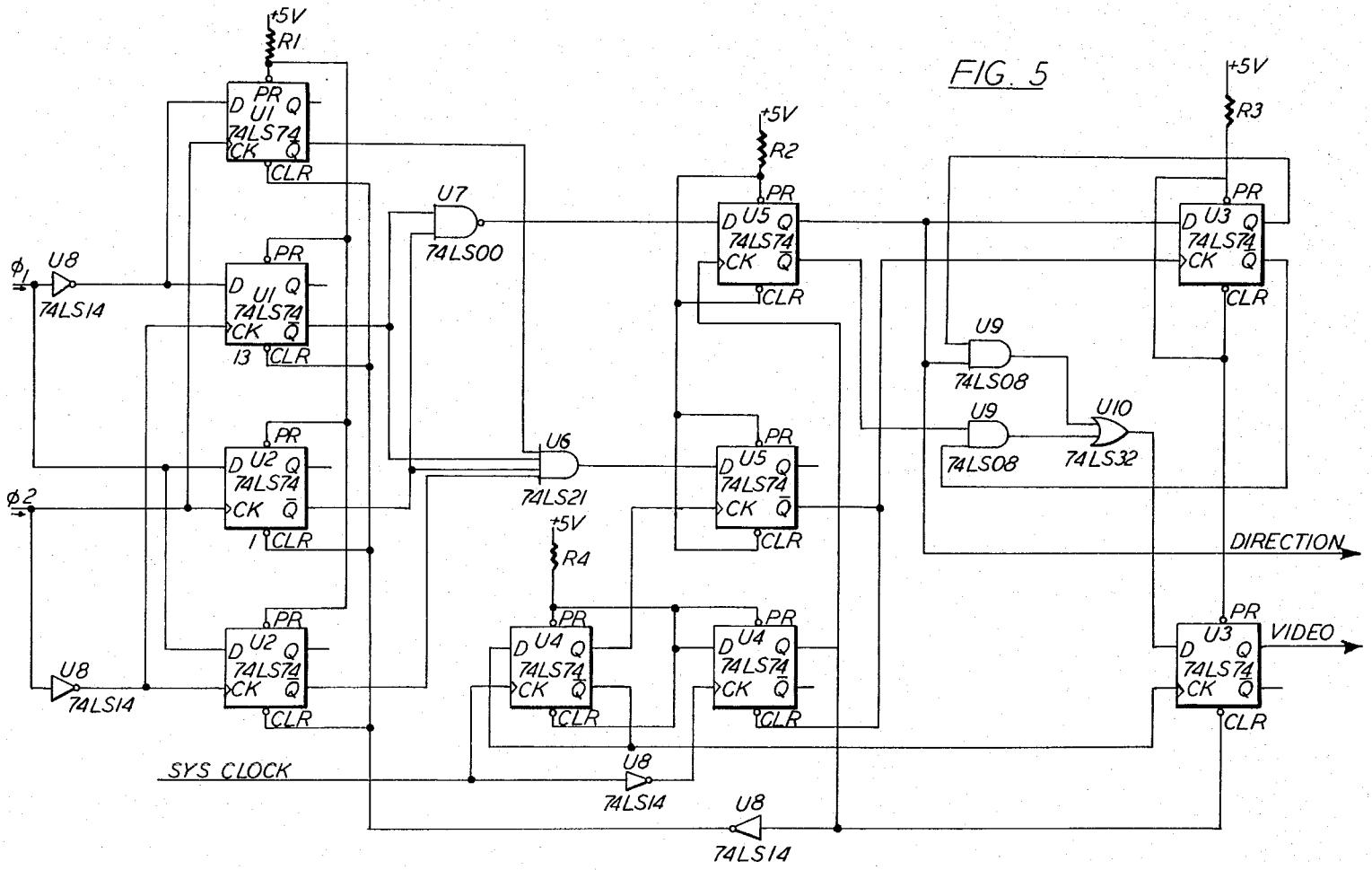
FIG. 5 is a schematic diagram of the logic circuit responsive to the electrical output from the optical sensor arrangement.

The respective outputs of the comparators are digital signals $\phi_1$ and $\phi_2$, FIG. 5 is a schematic of a logic circuit to provide direction and video signals from signals $\phi_1$ and $\phi_2$, which signals are fed to the circuit on inputs designated $\phi_1$ and $\phi_2$ respectively. Other inputs are 5 volt supplies fed by way of resistors $R_1$, $R_2$, $R_3$ and $R_4$ and a system clock pulse input (SYS CLOCK). The components and inputs and outputs of the components are identified in the schematic as follows:

$U_1$'s, $U_2$'s, $U_3$'s, $U_4$'s and $U_5$'s (74LS74) are Standard LS TTL Positive Edge Triggered D Flip Flops.
$U_6$ (74LS21) and $U_9$'s (74LS08) and are And gates.
$U_7$ (74LS00) is a Nand gate.
$U_{10}$ (74LS32) is an Or gate.
$U_8$'s (74LS14) are Standard Invertors with hysteresis.
CLR is "Clear" input.
CK is "Clock" input.
D is "Data" input.
PR is "Preset" Input.
Q is "Output".
$\overline{Q}$ is "Complimentary Output".

The component inputs and interconnections are as illustrated. Detailed description of these and circuit operations is unnecessary as these will be clearly apparent to a man skilled in the art. The circuit produces a direction signal indicating the direction of traverse of the carriage along the platen and a video signal which under stable conditions of traverse comprises a series of pulses corresponding to the leading and trailing edges of the digital signals $\phi_2$. Hence in stable conditions each signal generated by the Quadraphase Detector produces a single $\phi_2$ digital signal represented by two pulses in the video output. However, when, on the occurrence of a change of direction of travel of the carriage, $\phi_2$ has a leading edge and a trailing edge occurring without a leading edge or a trailing edge of $\phi_1$, interposed timewise therebetween, the circuit (U3) operates to omit the second (that associated with the trailing edge of $\phi_2$) pulse normally associated in the video signal with that $\phi_2$ signal. At the same time the state of the direction signal is changed to reflect the change in direction of traverse.

The omission of the second pulse in the change of direction aforementioned circumstance is an important feature for high frequency oscillation rejection. Without rejection a servo system with the slightest amount of torsional resonance will lose count and drift at zero speed crossings and at non-critically damped acceleration changes.

The circuit outputs of direction and video are inputted to a microprocessor. The output of the Quadraphase Detector (the video signal) is inputted to a microprocessor which keeps a 16 bit register of the horizontal position of the print head. The microprocessor measures the velocity (by measuring the number of video pulses received in the time of flight of print head) and acceleration by measuring the difference in two successive velocity measurements. As an alternate this could be done by hardware. The microprocessor uses the video pulses to unload a pin line buffer and generate firing pulses for the print head and uses the velocity and accelaration to modify the unloading address to compensate for the time of flight.

It will be appreciated that while a hard wired circuit providing the video signal has been described and illustrated, a microprocessor may be uitilized to carry out the same functions.

It will also be appreciated that in an arrangement in which the optical disc is reflective between the lines, the light transmitting arrangements and light detecting arrangements will be placed adjacent one another on the same side of the disc with the detecting arrangements arranged to receive light reflected by the areas between the lines.

Further, as will be apparent to a man skilled in the art, the optically detectable pattern of indicia could be replaced by a pattern of non-optical indicia (e.g. magnetic, capacitive, structural, deformation, etc.) with associated detector changes without departing from the inventive concept. In addition the disc/pulley could be replaced by a drum peripherally carrying the indicia or other rotatable indicia carrying means etc., also without departing from the inventive concept.

I claim:

1. In a dot matrix printer for computer printout having an elongate platen and a print head carriage supported for relative movement therebetween longitudinally of the platen, a dot matrix print head on said carriage, said print head comprising a plurality of dot matrix print elements arranged transversely of the platen axis in a predetermined array, means for supporting said carriage for movement along said platen, means for activating said print elements at a predetermined location along said platen, means for driving said carriage with continuous motion along said platen, a position indicator, for ascertaining the position of said carriage longitudinally of said platen, comprising a rotary optical position encoder rotatably mounted on an axis fixed longitudinally of said platen, a carriage position responsive means connected to said encoder and to said carriage on opposite sides of said print head to transmit said relative movement to said encoder to rotate said encoder in synchronism with said relative movement, the connections between the print head and the responsive means being sufficiently close to said array of dot matrix print elements to accurately indicate the position of said dot matrix print head to within one or two mils of its true position despite play in the carriage support means, said position responsive means being flexible and non extensible under the forces necessary to drive said encoder and being separate from said carriage driving means, said flexible position responsive means being the sole means for driving said encoder, whereby said connections cause the encoder to accurately track the position of the dot matrix print array despite play in the carriage support, said encoder having a pattern of detectable indicia, and a detector responsive to said indicia to provide a signal indicative of the rate, amount and direction of movement rotation of said encoder, said encoder providing input to the means for activating said print elements in accordance with the indicated position.

2. In a printer, a position indicator according to claim 1 wherein said indicia carried by said position encoder is detectable optically.

3. In a printer, a position indicator according to claim 2 wherein said encoder is a disc carrying equi-spaced opaque lines radially disposed in an annular array relative to said axis of rotation the disc.

4. In a printer, a position indicator according to claim 3 wherein the detector comprises a source of light disposed to direct light through the spaces between the annular array and a light detector to receive said light and to provide a signal, responsive to movement of the array, which is indicative of said position.

5. In a printer, a position indicator according to claim 4 wherein said source of light is a light emitting diode, said light detector is a quadraphase light detector, said light is focused onto a discrete area of said array by a lens and said quadraphase light detector receives light transmitted through the array by way of a quadraphase reticle which is optically aligned with and a lens which focuses said transmitted light onto said reticle.

6. In a printer, a position indicator according to claim 5 wherein said reticle and light detector are disposed closely adjacent said encoder disc.

7. In a printer, a position indicator according to claim 1 wherein said print head is a dot-matrix print head having a plurality of print wires terminating at a printing location, said carriage position responsive means is a flexible elongate member connected at both ends to said carriage, closely adjacent the printing location, and extending from said carriage by way of an idler wheel, rotatably mounted adjacent one of two opposite ends of said elongate platen, to said encoder and back to said carriage, said encoder being mounted at the other end of said platen.

8. In a printer, a position indicator according to claim 7 wherein the elongate member is a cable and said idler wheel and said encoder are pulleys each having a groove formed in its periphery to engage said cable for slip free rotation thereby.

* * * * *